US007710376B2

(12) United States Patent
Edo et al.

(10) Patent No.: US 7,710,376 B2
(45) Date of Patent: May 4, 2010

(54) DISPLAY AND METHOD OF DRIVING SAME

(75) Inventors: Susumu Edo, Mito (JP); Shoichi Hirota, Hitachi (JP)

(73) Assignee: Hitachi Displays, Ltd., Mobara-shi (JP)

( * ) Notice: Subject to any disclaimer, the term of this patent is extended or adjusted under 35 U.S.C. 154(b) by 1117 days.

(21) Appl. No.: 11/352,234

(22) Filed: Feb. 13, 2006

(65) Prior Publication Data

US 2006/0181497 A1 Aug. 17, 2006

(30) Foreign Application Priority Data

Feb. 14, 2005 (JP) ..... 2005-036652

(51) Int. Cl.
*G09G 3/36* (2006.01)

(52) U.S. Cl. ..... 345/92; 345/94

(58) Field of Classification Search ..... 345/90, 345/94, 87, 76, 78, 92
See application file for complete search history.

(56) References Cited

U.S. PATENT DOCUMENTS 5,296,847 A * 3/1994 Takeda et al. ..... 345/92
5,526,012 A * 6/1996 Shibahara ..... 345/92
5,952,991 A * 9/1999 Akiyama ..... 345/98
2002/0130829 A1* 9/2002 Ilda et al. ..... 345/87
2003/0076282 A1* 4/2003 Ikeda et al. ..... 345/55
2005/0057478 A1* 3/2005 Miyazawa ..... 345/96
2005/0068279 A1* 3/2005 Hirota et al. ..... 345/87
2005/0258466 A1* 11/2005 Kwak et al. ..... 257/306

FOREIGN PATENT DOCUMENTS

| | | |
|---|---|---|
| JP | 2-272521 | 11/1990 |
| JP | 7-111341 | 4/1995 |
| JP | 10-319909 | 12/1998 |
| JP | 2002-341828 | 11/2002 |
| JP | 2003-302936 | 10/2003 |

* cited by examiner

*Primary Examiner*—Chanh Nguyen
*Assistant Examiner*—Robert M Stone
(74) *Attorney, Agent, or Firm*—Antonelli, Terry, Stout & Kraus, LLP.

(57) ABSTRACT

A display with low power consumption using a memory-incorporated pixel system capable of refreshing the image signal memory and updating an image without causing a flicker. Each pixel arranged in matrix has, at an intersection between the signal line and the scan line, a first transistor and a second transistor to drive the electrooptical medium. The second transistor has its gate connected with the image signal memory which in turn is connected to the reference voltage line. There is a parasitic capacitor between the gate of the second transistor and the scan line. The gate of the second transistor is also connected with an added capacitor. Further, the second transistor is connected with a holding capacitor and also has a parasitic capacitor.

15 Claims, 10 Drawing Sheets

DISPLAY AND METHOD OF DRIVING SAME

BACKGROUND OF THE INVENTION

The present invention relates to a display and a method of driving the display and more particularly to a TFT (Thin Film Transistor) active matrix display.

For digitizing contents that have conventionally been provided in the form of paper, such as books and newspapers, a display with as high a resolution as printed matters is desired. The resolution of the currently available displays, however, is 200 ppi (pixels per inch) at the highest, far less than that of printed matters. The conventional displays have another problem that even at a resolution of around 200 ppi a large number of pixels used consumes a large amount of electricity.

A most effective method for reducing power consumption is to reduce a frame frequency. A reduction in frame frequency may be achieved by having a memory in pixels. In liquid crystal displays having a memory in pixels, an example of a conventional pixel circuit configuration related to this invention is disclosed in JP-A-2-272521.

In a system having a memory in pixels, JP-A-2003-302936 describes that, in an amorphous TFT, a transistor for driving an OLED (Organic Light Emitting Diode), an increased component of a threshold voltage (Vth) is removed by turning on or off a gate voltage and a drain voltage simultaneously.

Further, in the system having a memory in pixels, JP-A-2002-341828 describes that a display pixel circuit using organic EL (electroluminescence) devices adjusts a brightness of displayed image practically without reducing the number of grayscale levels of the image.

In such system having a memory in pixels, JP-A-10-319909 describes that a plurality of organic EL elements emit light for respective picture sub-frames with its own brightness, that images for each of sub-frames are visually combined and that brightness within a frame can be represented.

Further, in the system with a memory in pixels, JP-A-7-111341 describes that an organic thin film EL display reduces a failure rate caused by wire breaks and short circuits, by reducing a total wiring length and the number of crossings.

For a superfine resolution as high as printed matter, the number of pixels per unit area needs to be increased compared with the conventional displays. However, the use of the conventional display driving method to perform an image display at the superfine resolution requires increasing a reference clock frequency significantly, which results in a substantial increase in power consumption, making this method impractical.

One conceivable method for realizing a high resolution at low power consumption involves incorporating a memory in pixels and reducing the frame frequency. If a complex memory circuit such as static RAM or a CMOS transistor memory circuit is used, it is difficult to realize a high resolution.

To realize both a high resolution and a low power consumption at the same time, this invention adopts a memory-incorporated pixel system of single channel transistor configuration which is the simplest configuration. The memory-incorporated pixel system using the single channel transistor configuration has two single channel transistors for each pixel.

In the case of the CMOS transistor configuration, one of two reference voltage lines can be chosen, whereas the conventional single channel transistor configuration has only one reference voltage line and thus no method is available so far to switch from one state to another without adversely affecting the image display performance.

It is therefore an object of this invention to realize a display using a memory-incorporated pixel system of single channel transistor configuration which performs refreshing of image signal memories and updating of an image without adversely affecting the display performance and which has an ultrahigh resolution comparable to that of printed matter and a lower power consumption. It is also an object of this invention to provide a method of driving such a display.

SUMMARY OF THE INVENTION

Viewed from one aspect the present invention provides a display comprising: a plurality of pixels arranged in matrix; wherein each of the pixels has at least a first transistor, a second transistor, an image signal memory, an added capacitor, an electrooptical medium, and a common electrode; wherein each of the pixels is connected to at least a signal line, a scan line and a reference voltage line; wherein one of drain and source of the first transistor is connected to the signal line; wherein the other of drain and source of the first transistor is connected to a gate of the second transistor; wherein a gate of the first transistor is connected to the scan line; wherein one of drain and source of the second transistor is connected to the electrooptical medium; wherein the other of drain and source of the second transistor is connected to the reference voltage line; wherein the image signal memory is connected to a gate of the second transistor and the reference voltage line; wherein the added capacitor is connected to the gate of the second transistor and to one of drain and source of the second transistor; wherein the electrooptical medium is connected to one of drain and source of the second transistor and to the common electrode.

In another aspect of the present invention, a method for driving the display defined in the first aspect includes the steps of: refreshing the image signal memory during a scanning period by a voltage applied through the signal line; and holding, by a voltage applied through the signal line and a voltage applied through the reference voltage line, an image signal written into the image signal memory during an image hold period; wherein in the image hold period a drive waveform of the reference voltage line is a rectangular waveform of a particular frequency; wherein a period of selecting one scan line during the scanning period has a reset period to initialize a voltage difference between ends of the electrooptical medium and an image signal write period to write an image signal into the image signal memory; wherein in the image signal write period, a voltage of the signal line is set to a high level or a low level according to the image signal.

This invention therefore can provide a low power consumption display which uses a memory-incorporated pixel technology and which can perform refreshing of the image signal memory and update an image without causing a flicker. This invention also provides a method of driving such a display.

DETAILED DESCRIPTION OF THE EMBODIMENTS

Embodiments of this invention will be described by referring to the accompanying drawings.

Figure 1:
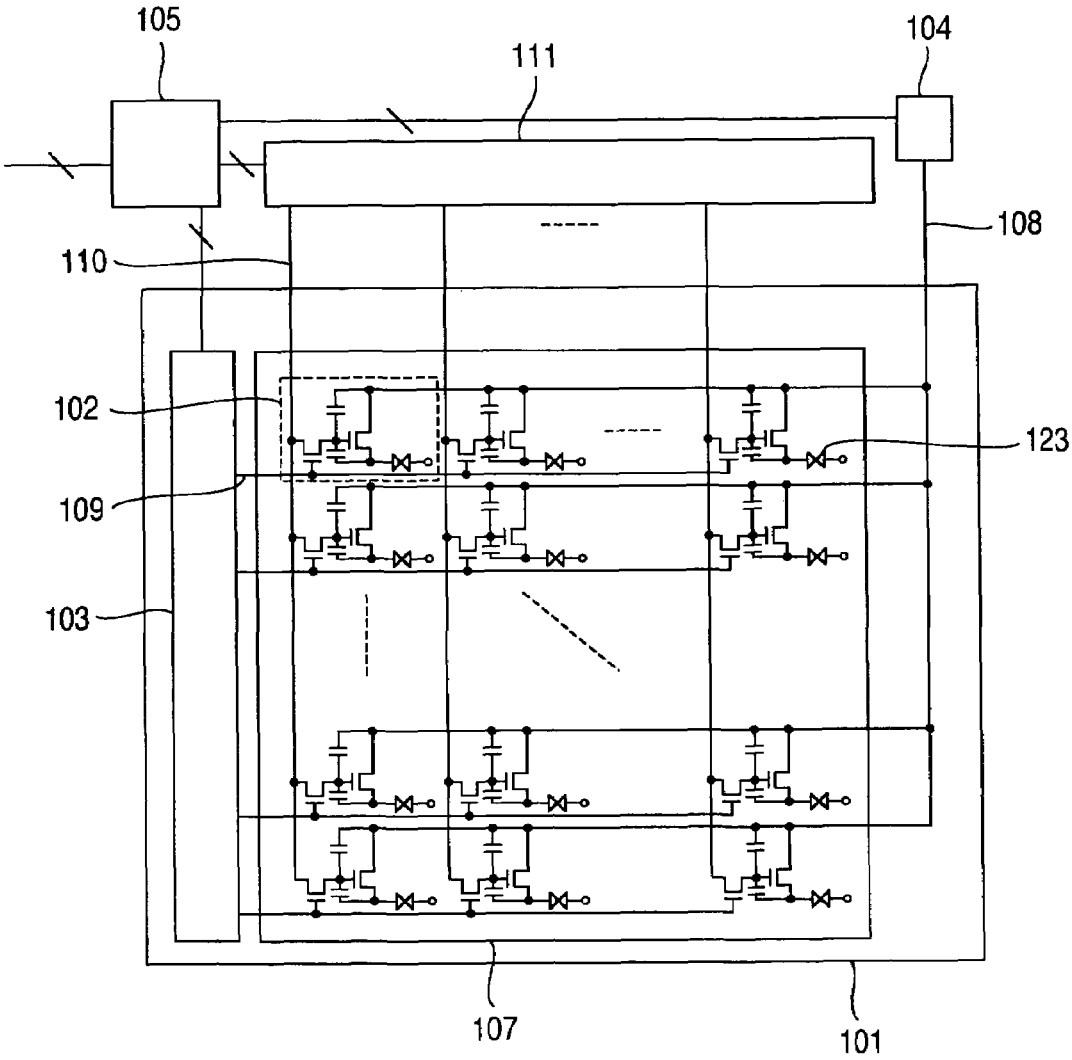
FIG. 1 is a block diagram of a display according to this invention.

FIG. 1 is a block diagram of a display according to this invention which comprises: a panel unit 101, or a so-called active matrix printed circuit board having a display unit 107 formed with a matrix of a plurality of pixels 102; a scan line driver 103 for driving scan lines 109; a timing controller 105; and a signal line driver 111 for driving signal lines 110.

The pixels 102 have an electrooptical medium 123 which controls each pixel 102 electrically independently to control a brightness of each pixel and thereby display a desired image.

The timing controller 105 receives a timing signal and an image signal from external devices not shown. The timing controller 105 controls the signal line driver 111, the scan line driver 103, and a reference voltage circuit 104. The reference voltage circuit 104 drives a reference voltage line 108.

Although in FIG. 1 the control circuits such as signal line driver 111 and timing controller 105 are provided separate from the panel unit 101, they may be formed directly on the panel unit 101.

Figure 2:
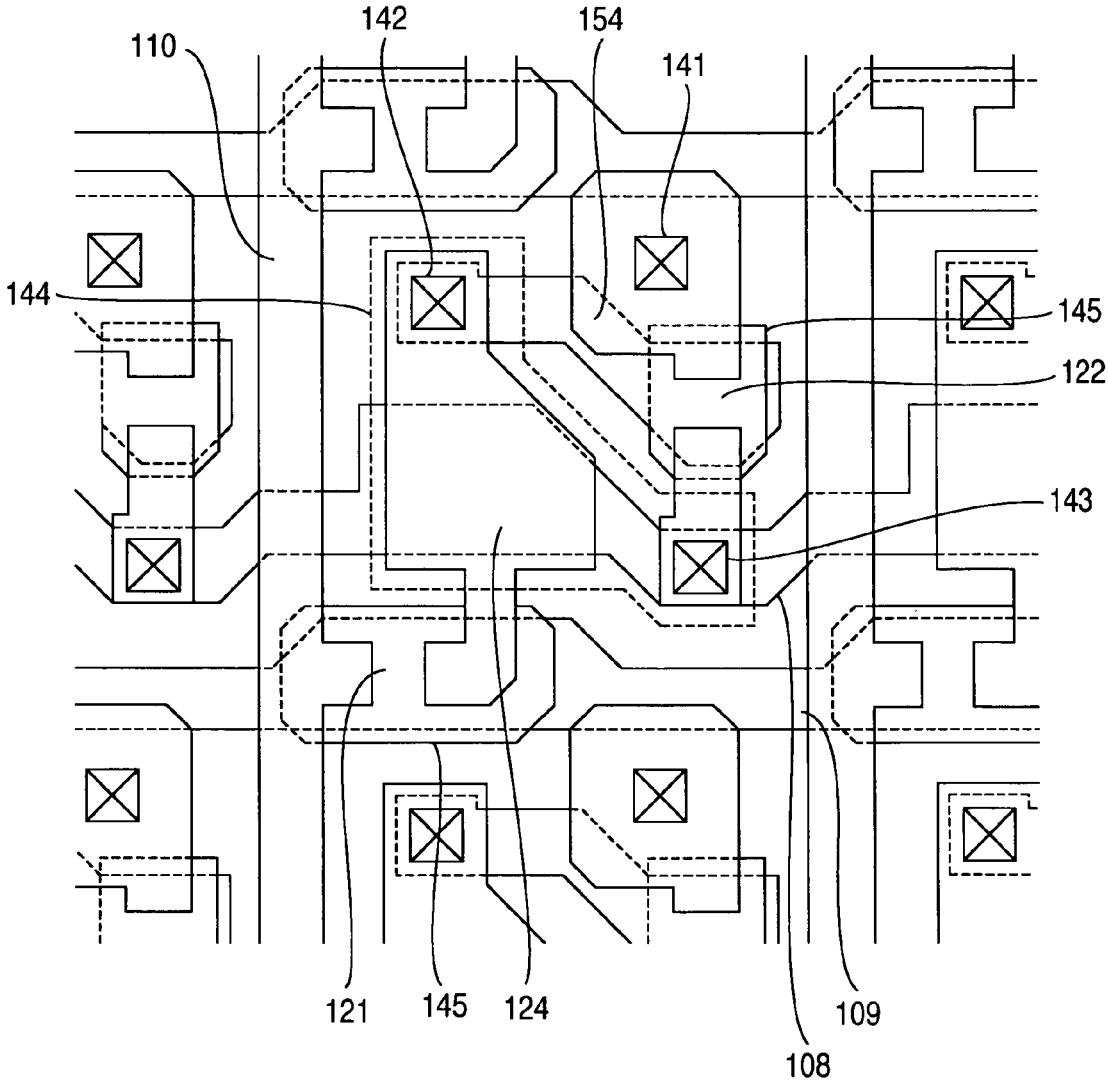
FIG. 2 is a layout diagram showing a pixel unit in a layer below a reflective electrode 146.
Figure 3:
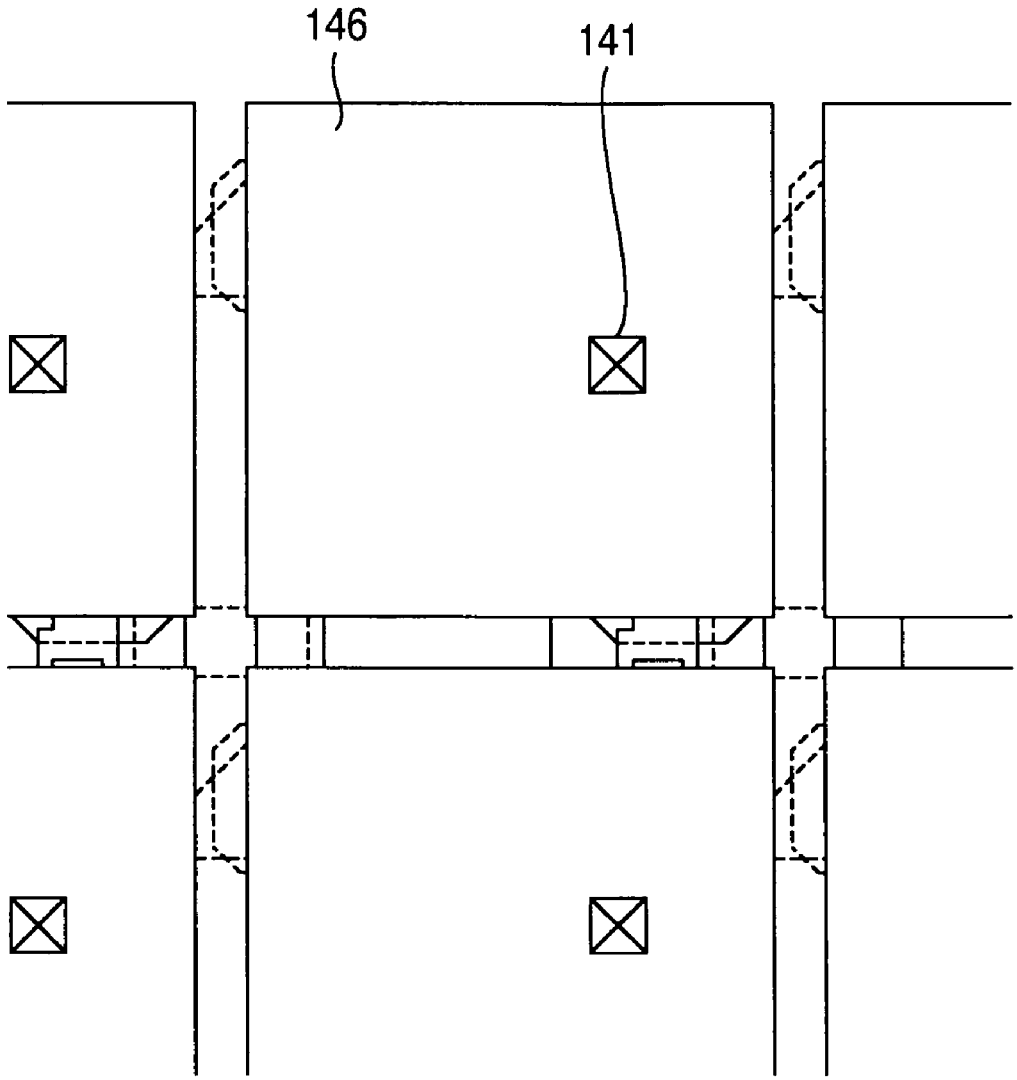
FIG. 3 is a layout diagram showing the pixel unit including the reflective electrode 146.

FIG. 2 and FIG. 3 are layout diagrams of the pixels 102 of FIG. 1, each of which has, at an intersection of the signal line 110 and the scan line 109, a first transistor 121 and a second transistor 122 with its gate connected via a through-hole contact 142 to a source of the first transistor 121 on the opposite side of the signal line 110.

The first transistor 121 and the second transistor 122 in this embodiment are amorphous silicon TFTs (thin film transistors) using an amorphous silicon layer 145 as a semiconductor layer.

The source electrode of the first transistor 121 and an electrode 144, which is connected to the reference voltage line 108 and the source or drain of the second transistor 122 via a through-hole contact 143, together form a capacitor that functions as an image signal memory 124.

The gate electrode of the second transistor 122 forms a capacitor as an added capacitor at an overlapping portion 154 between it and the source or drain of the second transistor. One of the source and drain of the second transistor 122 is connected via a through-hole contact 141 to a reflective electrode 146 (FIG. 3) disposed on the pixel 102.

Figure 4:
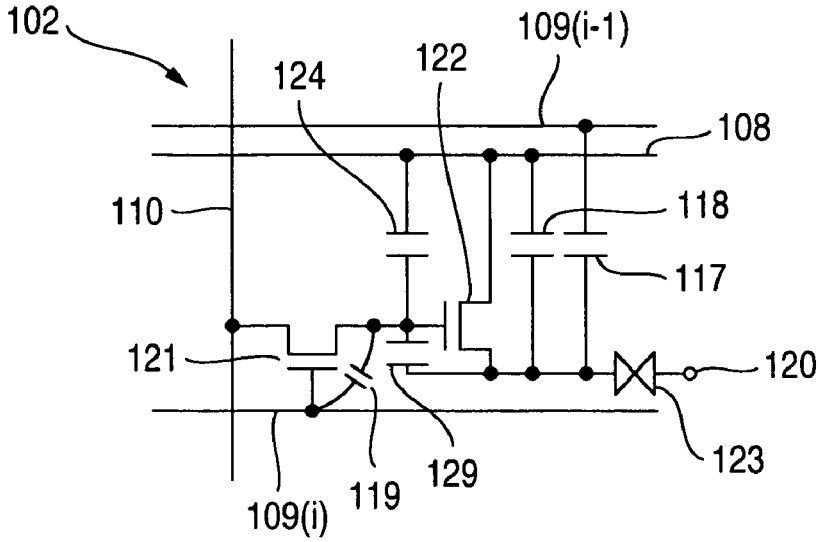
FIG. 4 is a circuit configuration diagram of a pixel 102.

An equivalent circuit of the pixel 102 of the above layout is shown in FIG. 4. The first transistor 121 has its gate connected to a scan line 109(*i*) at an i-th row, one of its drain and source connected to the signal line 110, and the other of the drain and source connected to one end of the image signal memory 124 and to the gate of the second transistor 122.

The other end of the image signal memory 124 is connected to the reference voltage line 108. One of the drain and source of the second transistor 122 is connected to the electrooptical medium 123 and the other to the reference voltage line 108.

Between the gate and the drain or source of the second transistor 122 is connected an added capacitor 129. A holding capacitor 117 is connected between one of the drain and source of the second transistor 122 and a scan line 109(*i*-1), which is one row before. One end of the electrooptical medium 123 opposite the second transistor 122 is connected to a common electrode 120.

The common electrode 120 is provided on the same printed circuit board as the TFT or on an opposing printed circuit board, or both, depending on the kind of the electrooptical medium 123. Further, there is a TFT parasitic capacitor 119 between the gate of the first transistor 121 and the other of its drain and source. Further, there is a pixel electrode parasitic capacitor 118 between one of the drain or source of the second transistor 122 and the reference voltage line 108.

The transistors in this embodiment are thin film transistors (TFTs). The TFTs may use amorphous silicon TFTs or polysilicon TFTs. Organic TFTs using organic semiconductors may also be used.

In this embodiment, an example case in which a liquid crystal display system uses a liquid crystal as the electrooptical medium 123 will be described. Examples of the liquid crystal display system include a reflective twisted nematic system, a guest-host liquid crystal system, and a reflective homeotropic ECB (Electrically Controlled Birefringence) system.

A reflective in-plane switching system can also be used. In that case, the common electrode 120 is provided on the same printed circuit board as the TFT.

The method of driving the display of this invention will be explained as follows. First, for easy understanding, let us explain about the driving method with the parasitic capacitors 118, 119, the added capacitor 129 and the holding capacitor 117 removed, by referring to FIG. 5. Then, the actual driving method will be described referring to FIG. 4.

Figure 5:
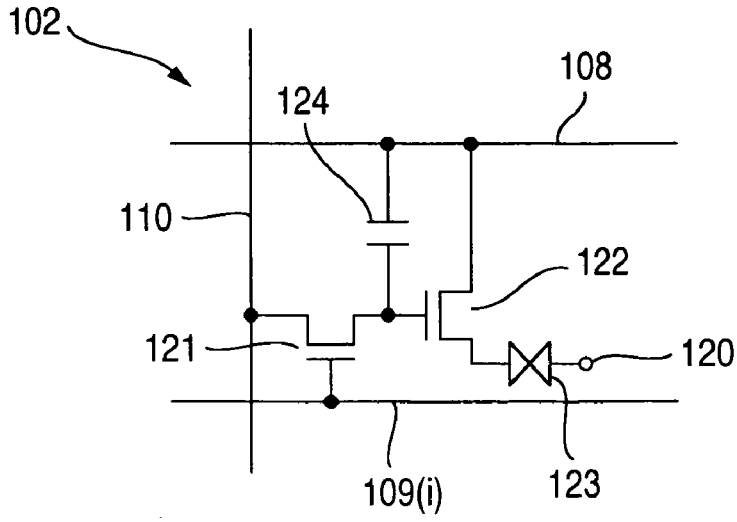
FIG. 5 is a fundamental circuit configuration diagram of the pixel 102.

FIG. 5 is a fundamental circuitry of a pixel circuit. The first transistor 121 has its gate connected to an i-th row scan line 109(*i*), one of its drain and source connected to the signal line 110, and the other of drain and source connected to one end of the image signal memory 124 and to a gate of the second transistor 122.

The other end of the image signal memory 124 is connected to the reference voltage line 108. The second transistor 122 has one of its drain and source connected to the electrooptical medium 123 and the other of drain and source connected to the reference voltage line 108. One end of the electrooptical medium 123 opposite the second transistor 122 is connected to a common electrode 120.

The common electrode 120 is provided on the same printed circuit board as the TFT or on an opposing printed circuit board, or both, depending on the kind of the electrooptical medium 123.

A drive waveform for driving the pixel of the configuration shown in FIG. 5 will be explained for a case of writing black data and for a case of writing white data, separately.

Figure 6A:
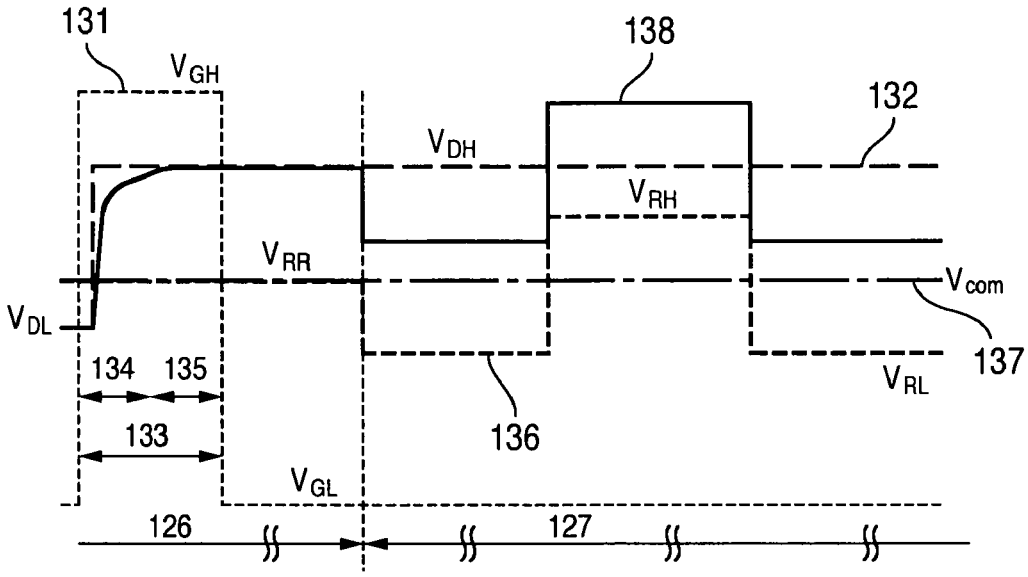
FIGS. 6A and 6B are fundamental drive sequence diagrams (when writing black data).
Figure 6B:
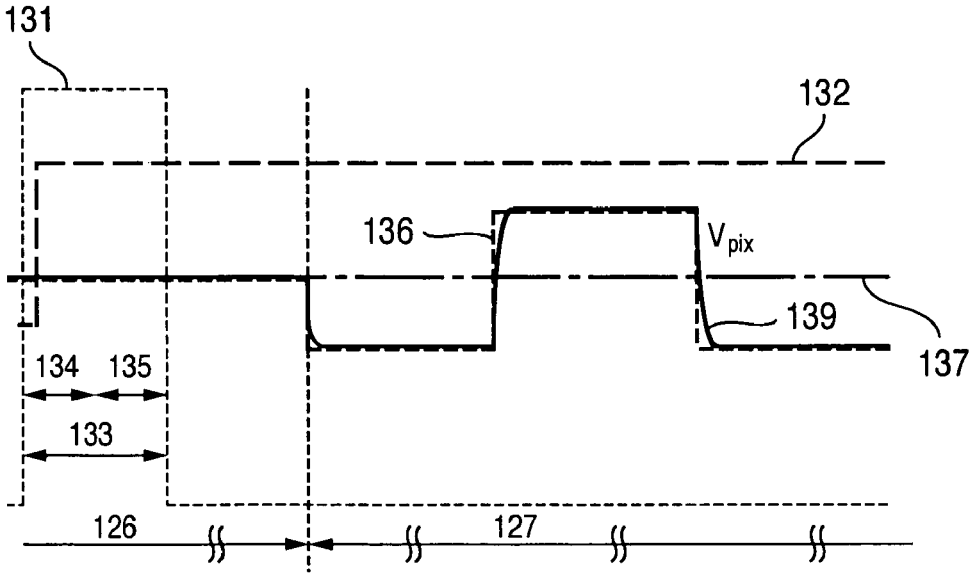

FIGS. 6A and 6B show drive waveforms when writing black data. FIG. 6A represents a gate waveform (voltage) 138 of the second transistor and FIG. 6B represents a pixel electrode voltage 139.

In FIGS. 6A and 6B, denoted 131 is a gate pulse, a pulse waveform ranging between voltage $V_{GL}$ and voltage $V_{GH}$. Denoted 132 is a drive waveform of the signal line, a pulse waveform ranging between voltage $V_{DL}$ and voltage $V_{DH}$.

Designated 136 is a drive waveform of the reference voltage line which can take one of three levels $V_{RR}$, $V_{RL}$, $V_{RH}$.

Denoted 137 is a common voltage which in this embodiment is a DC waveform of voltage $V_{com}$. Reference number 138 in FIG. 6A represents a gate waveform of the second transistor, and 139 in FIG. 6B represents an pixel electrode voltage. These reference numbers remain the same in the following waveform diagrams.

Reference number 126 represents a scanning period and 127 an image hold period. The scanning period 126 is a period in which to refresh the image signal memory 124 and to update a state of the voltage applied to the electrooptical medium 123, i.e., update the displayed image. The image hold period 127 is a period in which to halt the scanning of a screen and hold a display state of each pixel determined according to the state of the associated image signal memory 124.

Reference number 133 represents a selection period for one scan line, 134 a reset period in the selection period, and an image signal write period.

First, an operation of the scanning period 126 is explained. During the black data writing, the signal line voltage is $V_{DH}$ in both a reset period 134 and an image signal write period 135 and therefore is always $V_{DH}$ during a selection period 133 of one scan line.

Thus, a gate voltage 138 of the second transistor 122 is higher than the voltage $V_{RR}$ of the reference voltage line 108 by ($V_{DH}$−$V_{RR}$), turning on the second transistor. After the end of the selection period 133, the first transistor turns off and the gate voltage 138 of the second transistor is held in the image signal memory 124.

Since the electrooptical medium 123 is connected to the reference voltage line 108 through the second transistor, the pixel electrode voltage 139 (Vpix) is almost equal to voltage $V_{RR}$ of the reference voltage line, as shown in FIG. 6B.

Next, the image hold period 127 is explained. In the image hold period 127 during the black data writing, since the first transistor 121 is off, the gate of the second transistor 122 is floating and is connected to the reference voltage line 108 through the image signal memory 124.

Thus, as the voltage 136 of the reference voltage line 108 changes from $V_{RR}$ to $V_{RL}$ to $V_{RH}$, the gate voltage 138 of the second transistor also changes similarly, holding the second transistor turned on. The pixel electrode voltage 139 reaches the same voltage level as the reference voltage line 108 through the on-state second transistor.

The voltage 136 of the reference voltage line has a waveform with $V_{RH}$ and $V_{RL}$ alternating in a predetermined cycle and is set so as to make the absolute values of $V_{com}$−$V_{RH}$ and $V_{com}$−$V_{RL}$ equal. By changing the reference voltage line voltage 136 from $V_{RH}$ to $V_{RL}$, the liquid crystal is driven in an AC mode. A polarity reversal is suitably performed every several ms to dozen ms.

Figure 7A:
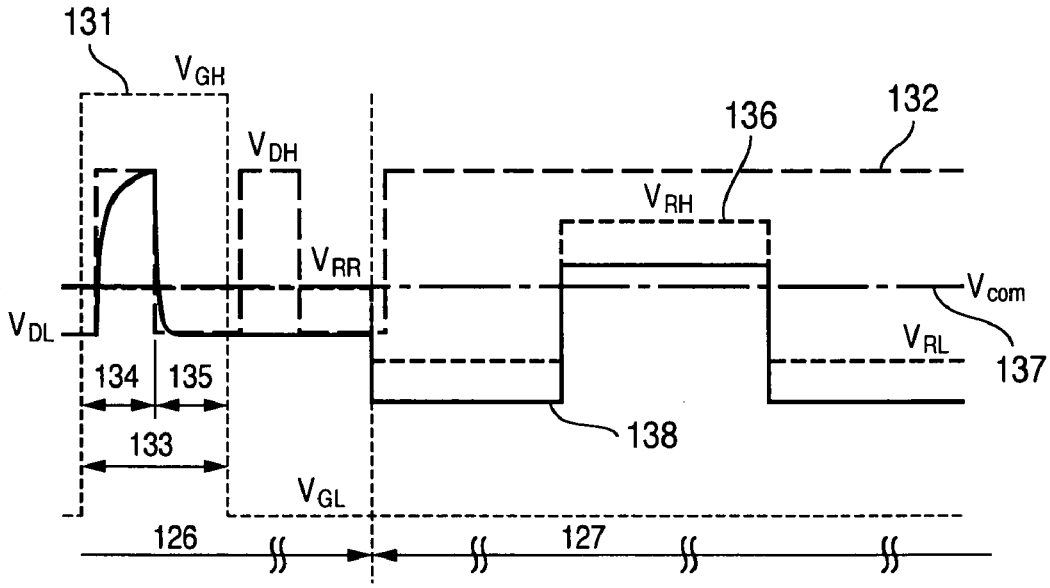
FIGS. 7A and 7B are fundamental drive sequence diagrams (when writing white data).
Figure 7B:
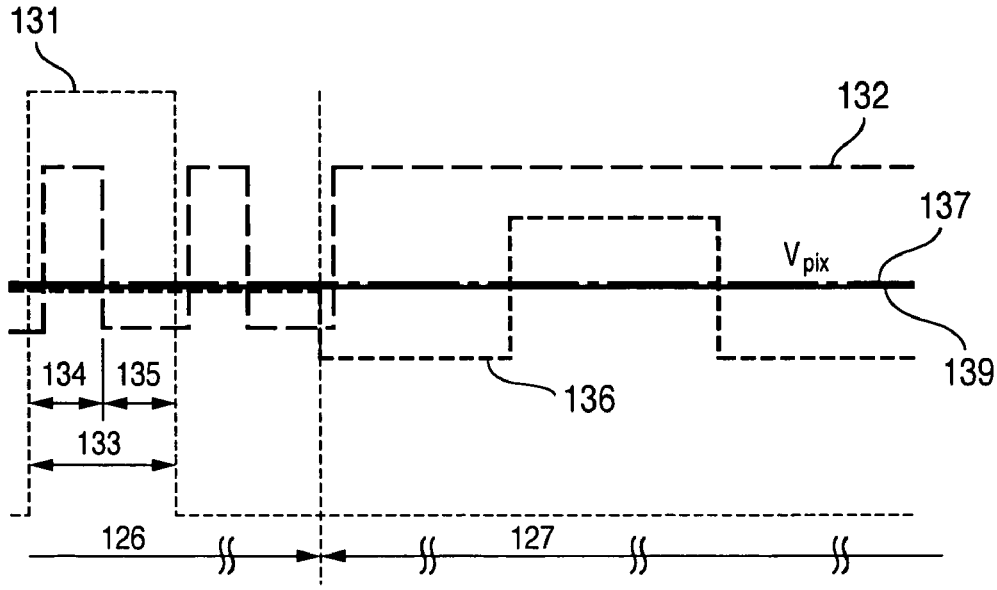

FIGS. 7A and 7B show drive waveforms during the white data writing, FIG. 7A representing a gate waveform (voltage) 138 of the second transistor and FIG. 7B representing the pixel electrode voltage 139.

During the white data writing, a signal line voltage 132 is $V_{DH}$ in the reset period 134 and, in the image signal write period 135, is $V_{DL}$. Thus, at the end of the scan line selection period 133 the other of drain and source of the second transistor 122 has a voltage $V_{RR}$ and the gate voltage 138 of the second transistor 122 is $V_{DL}$.

Here, since $V_{RR}$>$V_{DL}$, the second transistor 122 is off. In a reset period 134 at the first half of the scan line selection period 133 the second transistor 122 turns on. Since the reference voltage line 108 and the pixel electrode are connected through the ON-state second transistor 122, the pixel electrode voltage 139 becomes $V_{RR}$.

After the end of the scan line selection period 133, the first transistor 121 turns off and the gate voltage 138 of the second transistor 122 is held in the image signal memory 124. The only difference from the black data writing is that at the end of the scan line selection period 133, the second transistor 122 is off.

Similarly, during the white data writing, the gate voltage 138 of the second transistor 122 in the image hold period 127 varies with the reference voltage line 108 by the capacitance coupling of the image signal memory 124, holding the second transistor 122 turned off, as in the black data.

Since the second transistor is off, the pixel electrode voltage 139 is not influenced by the voltage 136 of the reference voltage line 108 and holds the voltage $V_{RR}$ (=$V_{com}$) written during the scanning period 126 thereby displaying white.

It is noted, however, that since the reference voltage line 108 is connected commonly to all pixels and, as explained in connection with FIGS. 6A and 6B and FIGS. 7A and 7B, the reference voltage line voltage $V_{RR}$ is $V_{com}$ in the scanning period 126, the pixel electrode voltage 139 is $V_{com}$ across the entire screen during the scanning period 126 whether the data being written is white or black. Therefore, during the scanning period 126, the entire screen turns white, resulting in a flicker.

However, as shown in FIG. 4, inserting the added capacitor 129 to optimally set the waveform can prevent this flicker. This is explained in the following.

Figure 8A:
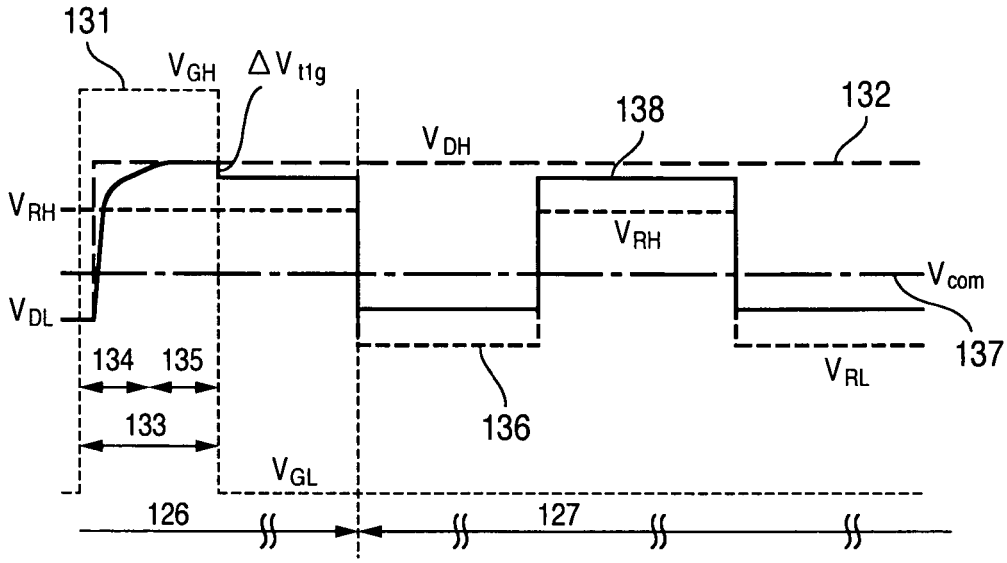
FIGS. 8A and 8B are drive sequence diagrams of this invention (when writing black data).
Figure 8B:
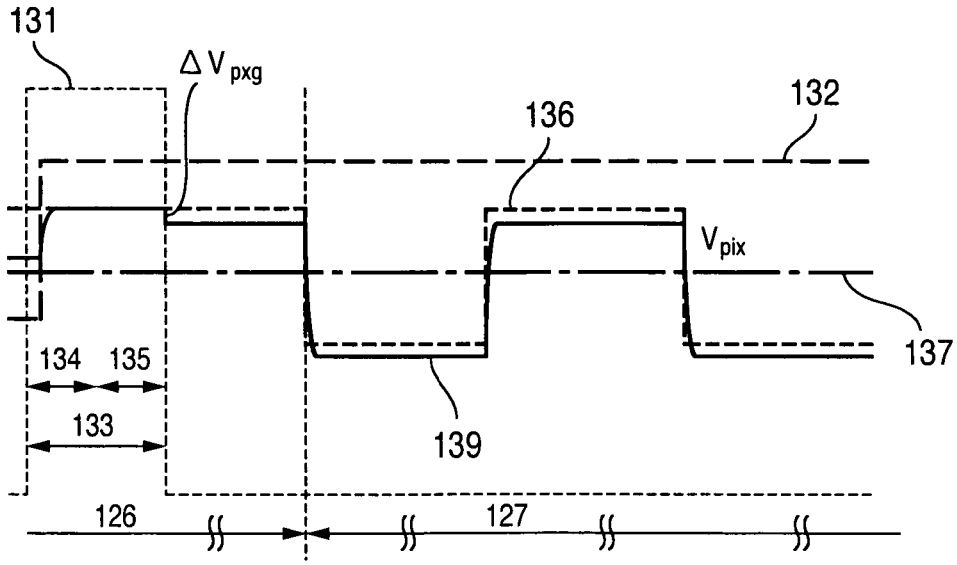
Figure 9A:
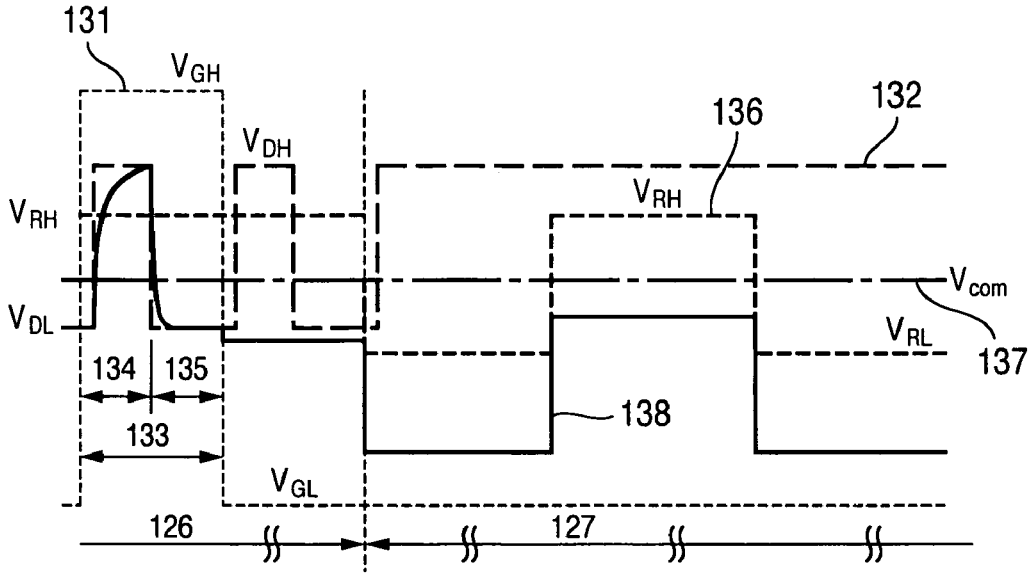
FIGS. 9A and 9B are drive sequence diagrams of this invention (when writing white data).
Figure 9B:
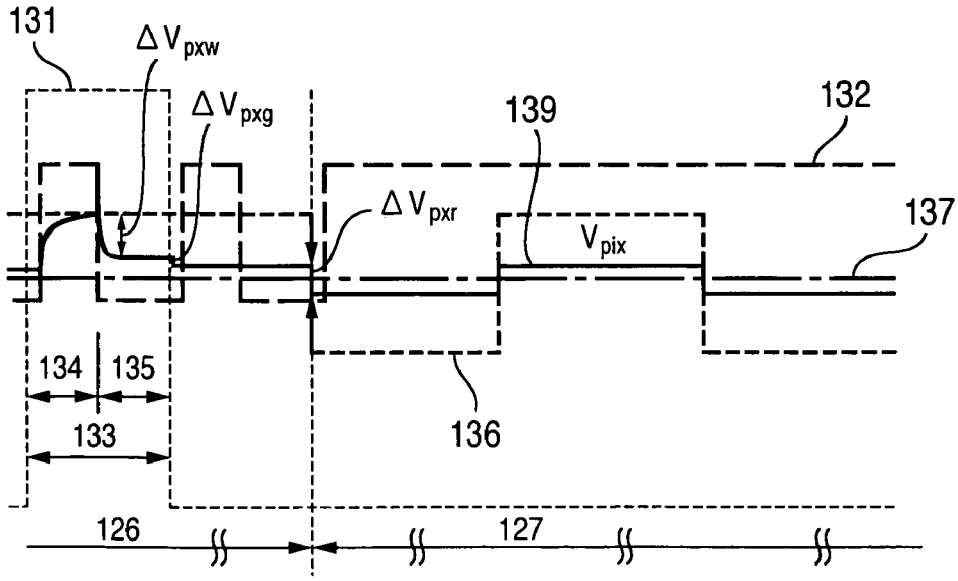

The drive waveform used to drive the actual pixel circuit shown in FIG. 4 will be explained. FIG. 8A shows a waveform of the gate voltage 138 of the second transistor 122 when writing black data; FIG. 8B shows a waveform of the pixel electrode voltage 139 when writing black data; FIG. 9A shows a waveform of the gate voltage 138 when writing white data; and FIG. 9B shows a waveform of the pixel electrode voltage 139 when writing white data.

Fundamental operations are similar to those explained in FIGS. 6A and 6B and FIGS. 7A and 7B. As can be seen from FIG. 8B and FIG. 9B, there are primarily three pixel electrode voltage variation factors $\Delta V_{pxw}$, $\Delta V_{pxg}$ and $\Delta V_{pxr}$ caused by influences of various components shown in FIG. 4.

The variation factors will be explained here. In the following explanation, $C_{gs1}$ represents a capacitance of the TFT parasitic capacitor 119, $C_s$ a capacitance of the holding capacitor 117, $C_{pix}$ a capacitance (called a pixel capacitor) produced by the electrooptical medium 123 interposed between the pixel electrode and the common electrode, $C_{opc}$ a capacitance of the pixel electrode parasitic capacitor 118, $C_m$ a capacitance of the image signal memory 124, and $C_b$ a capacitance of the added capacitor 129.

$\Delta V_{pxg}$ occurs both during the white data writing and the black data writing when the voltage variation of the gate pulse 131 from $V_{GH}$ to $V_{GL}$ changes the pixel electrode voltage 139 by the capacitance coupling of the TFT parasitic capacitor 119 and the added capacitor 129. This variation factor may be expressed by equation (1):

$$\Delta V_{pxg} = \frac{C_{gs1}}{C_{gs1} + C_s + C_{pix} + C_{opc}} \Delta V_{t1g} \tag{1}$$

$\Delta V_{t1g}$ is expressed by equation (2).

$$\Delta V_{t1g} = \frac{C_{gs1}}{\frac{C_b(C_{opc} + C_{pix} + C_s)}{C_b + C_{opc} + C_{pix} + C_s} + C_m + C_{gs1}}(V_{GH} - V_{GL}) \quad (2)$$

$\Delta V_{pxw}$ occurs during the white data writing when the voltage variation of the signal line 110 from $V_{DH}$ to $V_{DL}$ while the first transistor 121 is on changes the pixel electrode voltage 139 by the capacitance coupling of the added capacitor 129. This variation factor may be expressed by equation (3):

$$\Delta V_{pxw} = \frac{C_b}{C_b + C_s + C_{pix} + C_{opc}}(V_{DH} - V_{DL}) \quad (3)$$

$\Delta V_{pxr}$ occurs during the image hold period 127 of white data when the voltage variation of the reference voltage line 108 from $V_{RH}$ to $V_{RL}$ in the image hold period 127 changes the pixel electrode voltage 139 by the capacitance coupling of the pixel electrode parasitic capacitor $C_{opc}$, the image signal memory capacitor $C_m$ and the added capacitor $C_b$. This variation factor may be expressed by equation (4):

$$\Delta V_{pxr} = \frac{\frac{C_b \cdot C_m}{C_b + C_m} + C_{opc}}{\frac{C_b \cdot C_m}{C_b + C_m} + C_{opc} + C_s + C_{pix}}(V_{GH} - V_{GL}) \quad (4)$$

As can be seen from FIG. 9B, when white data is written, the voltage of the reference voltage line falls from $V_{RH}$ by $\Delta V_{pxw}+\Delta V_{pxg}$ during the scanning period 126 and further falls $\Delta V_{pxr}$ during the switching from the scanning period 126 to the image hold period 127.

Therefore, as shown in FIG. 7B, if the reference voltage line voltage $V_{RR}$ in the scanning period 126 is assumed to be $V_{com}$, a voltage of $\Delta V_{pxw}+\Delta V_{pxg}+\Delta V_{pxr}$ at maximum is applied to the liquid crystal during the image hold period 127, making it impossible to display white. However, when black data is written, no voltage variation occurs in the signal line voltage 132 during the scan line selection period 133, so that, as shown in FIG. 8B, the voltage variation in the pixel electrode voltage 139 ($V_{pix}$) is only $\Delta V_{pxg}$.

As described above, only during the white data writing, the pixel electrode voltage 139 varies greatly. By taking advantage of this fact, the pixels are driven such that the voltage $V_{RR}$ of the reference voltage line 108 during scanning period is made equal to $V_{RH}$ and that the pixel electrode voltage 139 for only those pixels that are written with white data is made almost equal to $V_{com}$ by using the voltage variations mentioned above. As a result, the pixel electrode voltage for the pixels that are written with black data can be set to $V_{RH}$ and the pixel electrode voltage for the pixels that are written with white data can be set to nearly $V_{com}$. Since these pixel electrode voltages are equal to the pixel electrode voltages during the holding period, no flicker occurs at all during the scanning period. That is, if the following equation (5) is satisfied, the flicker during the scanning period can be prevented. FIGS. 8A and 8B and FIGS. 9A and 9B show what has been described above. ($V_{RR}=V_{RH}$)

$$V_{RH} - \left(\Delta V_{pxw} + \Delta V_{pxg} + \frac{\Delta V_{pxr}}{2}\right) = V_{com} \quad (5)$$

Figure 10:
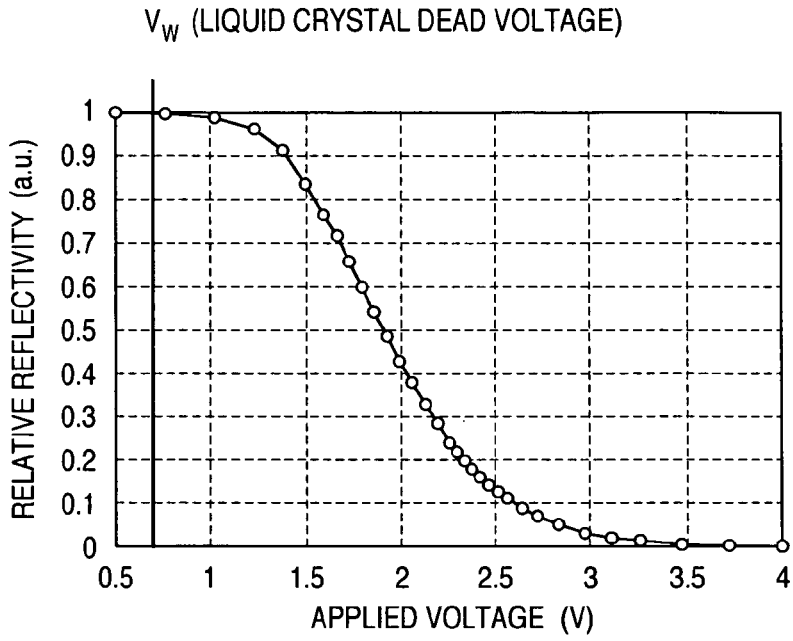
FIG. 10 is an applied voltage vs. reflectivity (brightness) characteristic of a liquid crystal display.

There are areas in the liquid crystal where its transmissivity does not change even when applied with a voltage. FIG. 10 shows an example of applied voltage vs. reflectivity (brightness) characteristic of liquid crystal. The brightness does not change even when applied with a voltage up to around 0.7 V. Let the maximum applied voltage that does not influence the brightness be a liquid crystal dead voltage $V_W$. In FIG. 9B, if $V_w \leqq \Delta V_{pxr}/2$, satisfying the conditions of both the following equations (6) and (7) can realize $V_{RR}=V_{RH}$ as in the above case and prevent flicker during the scanning period.

$$V_{com}-V_W \leqq V_{RH}-(\Delta V_{pxw}+\Delta V_{pxg}+\Delta V_{pxr}) \quad (6)$$

$$V_{com}+V_W \geqq V_{RH}-(\Delta V_{pxw}+\Delta V_{pxg}) \quad (7)$$

What should be noted here is that, when writing white data, the gate voltage of the second transistor 122 falls from $V_{DL}$ by $\Delta V_{t1g}+(V_{RH}-V_{RL})$, as shown in FIG. 9A, due to the capacitor coupling of the image signal memory 124 when the scanning period 126 is switched to the image hold period 127.

$V_{GL}$ must be a voltage that can turn off the first transistor 121 well. To hold this transistor turned off, $V_{GL}$ needs to be approximately 5 V less than the drain or source voltage. Thus, the following equation (8) holds.

$$V_{DL} \geqq V_{GL}+\Delta V_{t1g}+(V_{RH}-V_{RL})+5 \quad (8)$$

Driving the pixels under the conditions satisfying the above equation (5) and equation (8) or under the conditions satisfying all the equations (6), (7) and (8) can realize a displaying of image without causing a blanking on the entire screen during the scanning period, i.e., without a flicker.

Embodiment 2

It is noted, however, that when white data is written, the pixel capacitor $C_{pix}$ may change depending on the display state immediately before. This is caused by a dielectric constant anisotropy of the liquid crystal material.

As is seen from equation (3), if $C_{pix}$ changes, the value of $\Delta V_{pxw}$ also changes. If the immediately preceding display is black, $C_{pix}$ becomes large and $\Delta V_{pxw}$ becomes small. Conversely, when the immediately preceding display is white, $C_{pix}$ decreases and $\Delta V_{pxw}$ increases.

In this embodiment white is displayed by using $\Delta V_{pxw}$ to push down the pixel electrode voltage 139. So, if $\Delta V_{pxw}$ is small, the displayed image cannot be changed completely from black to white with a single refreshing, leaving a faint image like an afterimage for a period of a few refreshing operations. When the frame frequency is 1-2 Hz or less, the afterimage will remain for a few seconds.

Figure 11:
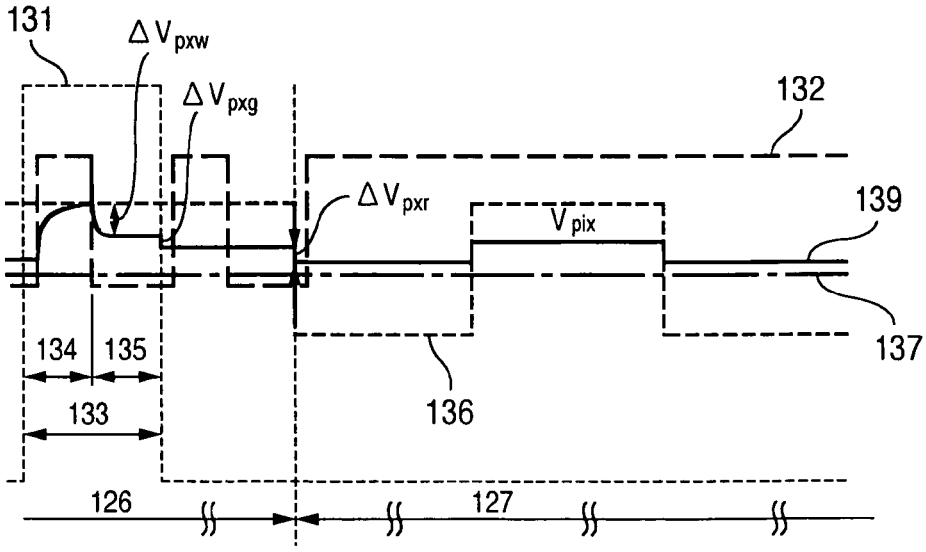
FIG. 11 is a drive sequence diagram of this invention (when writing white data).

FIG. 11 is a drive waveform diagram for the above case, showing the pixel electrode voltage 139 as the immediately preceding displayed image changes from black to white. For the reason described above, $C_{pix}$ is large. So, the value of $\Delta V_{pxw}$ is small and, compared with the case of FIG. 9B, the pixel electrode voltage 139 during the image hold period 127 is shifted in the positive direction.

Even in this state, there is no problem if equation (7) is met. If not, a phenomenon occurs in which a thin gray image remains at pixels which are supposed to display white. As a countermeasure to this problem, it is conceivable to provide a plurality of scanning periods 126.

Figure 12:
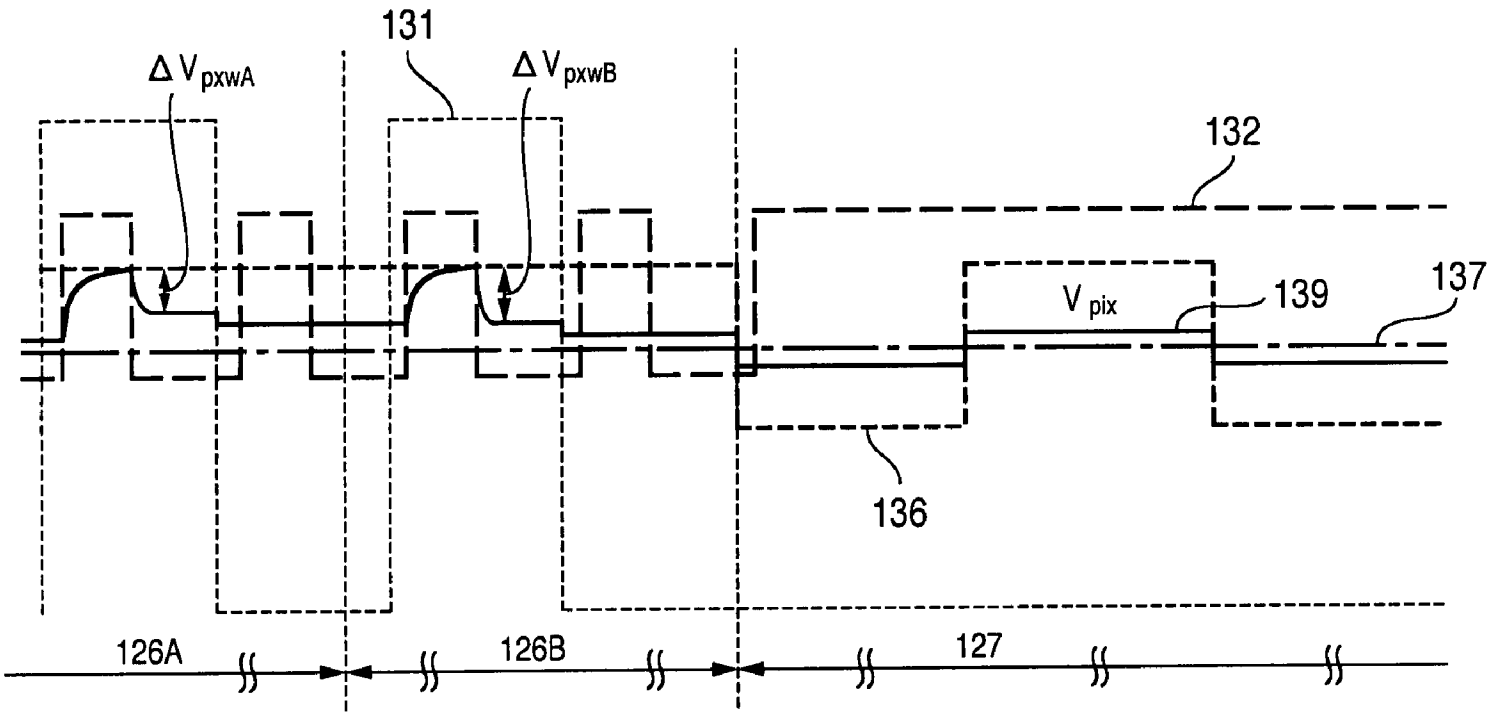
FIG. 12 is another drive sequence diagram of this invention (when writing white data).

FIG. 12 is a waveform diagram showing the pixel electrode voltage 139 when the scanning period 126 is provided twice as the immediately preceding displayed image changes from black to white.

At the end of the first scanning period 126A, equation (5) or equation (7) cannot be satisfied for the reason described above and thus a faint gray image remains. But in the second scanning period 126B the data is written again.

Since the pixel capacitor $C_{pix}$ in the first scanning period is different from that of the second scanning period, the pixel electrode variation $\Delta V_{pxwB}$ caused by data line voltage variation in the second scanning period 126B is larger than $\Delta V_{pxwA}$ in the first scanning period 126A.

Thus, it is made easier to satisfy equation (5) or equation (7). If equation (5) or equation (7) can not still be satisfied after the two scans, another scanning period may be added to meet equation (5) or equation (7).

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display comprising:

a plurality of pixels arranged in matrix;

wherein each of the pixels has at least a first transistor, a second transistor, an image signal memory, an added capacitor, an electrooptical medium, and a common electrode;

wherein each of the pixels is connected to at least a signal line, a scan line and a reference voltage line;

wherein one of drain and source of the first transistor is connected to the signal line;

wherein the other of drain and source of the first transistor is connected to a gate of the second transistor;

wherein a gate of the first transistor is connected to the scan line;

wherein one of drain and source of the second transistor is connected to the electrooptical medium;

wherein the other of drain and source of the second transistor is connected to the reference voltage line;

wherein the image signal memory is connected to a gate of the second transistor and the reference voltage line;

wherein the added capacitor is connected to the gate of the second transistor and to one of drain and source of the second transistor;

wherein the electrooptical medium is connected to one of drain and source of the second transistor and to the common electrode; and wherein a variation $\Delta V_{pxg}$ of a pixel electrode voltage of the electrooptical medium connected to one of drain and source of the second transistor is expressed by the following equations (1) and (2):

$$\Delta V_{pxg} = \frac{C_{gs1}}{C_{gs1} + C_s + C_{pix} + C_{opc}} \Delta V_{t1g} \tag{1}$$

wherein $$\Delta V_{t1g} = \frac{C_{gs1}}{\frac{C_b(C_{opc} + C_{pix} + C_s)}{C_b + C_{opc} + C_{pix} + C_s} + C_m + C_{gs1}} (V_{GH} - V_{GL}) \tag{2}$$

wherein $C_{gs1}$ represents a parasitic capacitance, $C_s$ represents a holding capacitance, $C_{pix}$ represents a capacitance of the electrooptical medium, $C_{opc}$ represents a pixel electrode parasitic capacitance, $C_m$ represents a capacitance of the image signal memory, $C_b$ represents an added capacitance, and $V_{GH}$ and $V_{GL}$ represent a gate voltage of the first transistor.

2. A display according to claim 1, wherein the added capacitor is formed of an overlapping portion between the gate of the second transistor and one of source and drain of the second transistor.

3. A display according to claim 1, wherein a parasitic capacitor exists between the gate of the first transistor and the other of drain and source of the first transistor.

4. A display according to claim 3, wherein a holding capacitor is connected between one of source and drain of the second transistor and a scan line of a preceding row, and a pixel electrode parasitic capacitor exists between one of source and drain of the second transistor and the reference voltage line.

5. A method of driving a display, wherein the display comprises a plurality of pixels arranged in matrix;

wherein each of the pixels has at least a first transistor, a second transistor, an image signal memory, an added capacitor, an electrooptical medium, and a common electrode;

wherein each of the pixels is connected to at least a signal line, a scan line and a reference voltage line;

wherein one of drain and source of the first transistor is connected to the signal line;

wherein the other of drain and source of the first transistor is connected to a gate of the second transistor;

wherein a gate of the first transistor is connected to the scan line;

wherein one of drain and source of the second transistor is connected to the electrooptical medium;

wherein the other of drain and source of the second transistor is connected to the reference voltage line;

wherein the image signal memory is connected to a gate of the second transistor and the reference voltage line;

wherein the added capacitor is connected to the gate of the second transistor and to one of drain and source of the second transistor;

wherein the electrooptical medium is connected to one of drain and source of the second transistor and to the common electrode;

the display driving method comprising the steps of:

(a) refreshing the image signal memory during a scanning period by a voltage applied through the signal line; and (b) holding, by a voltage applied through the signal line and a voltage applied through the reference voltage line, an image signal written into the image signal memory during an image hold period;

wherein in the image hold period a drive waveform of the reference voltage line is a rectangular waveform of a particular frequency;

wherein a period of selecting one scan line during the scanning period has a reset period to initialize a voltage difference between ends of the electrooptical medium and an image signal write period to write an image signal into the image signal memory;

wherein in the image signal write period, a voltage of the signal line is set to a high level or a low level according to the image signal;

wherein a parasitic capacitor is present between the gate of the first transistor and the other of drain and source of the first transistor;

wherein a holding capacitor is connected between one of source and drain of the second transistor and the scan line of a preceding row;

wherein a pixel electrode parasitic capacitor is present between one of source and drain of the second transistor and the reference voltage line; and wherein a variation $\Delta V_{pxg}$ of a pixel electrode voltage of the electrooptical medium connected to one of drain and source of the second transistor is expressed by the following equations (1) and (2):

$$\Delta V_{pxg} = \frac{C_{gs1}}{C_{gs1} + C_s + C_{pix} + C_{opc}} \Delta V_{t1g} \tag{1}$$

wherein $$\Delta V_{t1g} = \frac{C_{gs1}}{\frac{C_b(C_{opc} + C_{pix} + C_s)}{C_b + C_{opc} + C_{pix} + C_s} + C_m + C_{gs1}} (V_{GH} - V_{GL}) \tag{2}$$

wherein $C_{gs1}$ represents a parasitic capacitance, $C_s$ represents a holding capacitance, $C_{pix}$ represents a capacitance of the electrooptical medium, $C_{opc}$ represents a pixel electrode parasitic capacitance, $C_m$ represents a capacitance of the image signal memory, $C_b$ represents an added capacitance, and $V_{GH}$ and $V_{GL}$ represent a gate voltage of the first transistor.

6. A display driving method according to claim 5, wherein in the scanning period the voltage of the reference voltage line is set to a high level.

7. A display driving method according to claim 5, wherein a variation $\Delta V_{pxw}$ of the pixel electrode voltage is expressed by the following equation (3):

$$\Delta V_{pxw} = \frac{C_b}{C_b + C_s + C_{pix} + C_{opc}} (V_{DH} - V_{DL}) \tag{3}$$

where $V_{DH}$ and $V_{DL}$ represent a voltage of the signal line.

8. A display driving method according to claim 7, wherein a variation $\Delta V_{pxr}$ of the pixel electrode voltage is expressed by the following equation (4):

$$\Delta V_{pxr} = \frac{\frac{C_b \cdot C_m}{C_b + C_m} + C_{opc}}{\frac{C_b \cdot C_m}{C_b + C_m} + C_{opc} + C_s + C_{pix}} (V_{GH} - V_{GL}) \tag{4}$$

where $V_{RH}$ and $V_{RL}$ represent a voltage of the reference voltage line.

9. A display driving method according to claim 8, wherein the voltage of the reference voltage line during the scanning period is set to $V_{RR}=V_{RH}$ and satisfies the following equation (5):

$$V_{RH} - \left(\Delta V_{pxw} + \Delta V_{pxg} + \frac{\Delta V_{pxr}}{2}\right) = V_{com} \tag{5}$$

where $V_{com}$ represents a voltage of the common electrode.

10. A display driving method according to claim 8, wherein the voltage of the reference voltage line during the scanning period is set to $V_{RR}=V_{RH}$, a dead voltage of the electrooptical medium is taken to be $V_w$, and the display is driven under conditions of the following equations (6), (7) and (8):

$$V_{com} - V_W \le V_{RH} - (\Delta V_{pxw} + \Delta V_{pxg} + \Delta V_{pxr}) \tag{6}$$

$$V_{com} + V_W \ge V_{RH} - (\Delta V_{pxw} + \Delta V_{pxg}) \tag{7}$$

$$V_{DL} \ge V_{GL} + \Delta V_{t1g} + (V_{RH} - V_{RL}) + 5. \tag{8}$$

11. A display driving method according to claim 5, wherein a plurality of scanning periods are provided in one image hold period.

12. A display driving method according to claim 11, wherein a last variation $\Delta V_{pxwB}$ in the pixel electrode voltage of the electrooptical medium in the plurality of scan periods is larger than a first variation $\Delta V_{pxwA}$ in the pixel electrode voltage, the electrooptical medium being connected to one of drain and source of the second transistor.

13. A display comprising:

a plurality of pixels arranged in matrix, each pixel including a first transistor, a second transistor, an image signal memory, an added capacitor, an electrooptical medium, and a common electrode, and each pixel being connected to a signal line, a scan line and a reference voltage line, as follows:

(a) one of a drain and a source of the first transistor being connected to the signal line, (b) the other of a drain and a source of the first transistor being connected to a gate of the second transistor, (c) a gate of the first transistor being connected to the scan line, (d) one of drain and source of the second transistor being connected to the electrooptical medium, (e) the other of drain and source of the second transistor being connected to the reference voltage line, (f) the image signal memory being connected to a gate of the second transistor and the reference voltage line, (g) the added capacitor being connected to the gate of the second transistor and to one of drain and source of the second transistor, and (h) the electrooptical medium being connected to one of drain and source of the second transistor and to the common electrode;

wherein a variation $\Delta V_{pxg}$ of a pixel electrode voltage of the electrooptical medium connected to one of drain and source of the second transistor is expressed by the following equations (1) and (2):

$$\Delta V_{pxg} = \frac{C_{gs1}}{C_{gs1} + C_s + C_{pix} + C_{opc}} \Delta V_{t1g} \quad (1)$$

wherein $$\Delta V_{t1g} = \frac{C_{gs1}}{\frac{C_b(C_{opc} + C_{pix} + C_s)}{C_b + C_{opc} + C_{pix} + C_s} + C_m + C_{gs1}} (V_{GH} - V_{GL}) \quad (2)$$

and wherein $C_{gs1}$ represents a parasitic capacitance, $C_s$ represents a holding capacitance, $C_{pix}$ represents a capacitance of the electrooptical medium, $C_{opc}$ represents a pixel electrode parasitic capacitance, $C_m$ represents a capacitance of the image signal memory, $C_b$ represents an added capacitance, and $V_{GH}$ and $V_{GL}$ represent a gate voltage of the first transistor.

14. A display according to claim 1, wherein the display is configured to:

(a) refresh the image signal memory during a scanning period by a voltage applied through the signal line; and (b) hold, by a voltage applied through the signal line and a voltage applied through the reference voltage line, an image signal written into the image signal memory during an image hold period.

15. A display according to claim 14, the display being configured to:

(a) refresh the image signal memory during a scanning period by a voltage applied through the signal line; and (b) hold, by a voltage applied through the signal line and a voltage applied through the reference voltage line, an image signal written into the image signal memory during an image hold period.

* * * * *